US007757664B2

(12) United States Patent
Niizuma et al.

(10) Patent No.: US 7,757,664 B2
(45) Date of Patent: Jul. 20, 2010

(54) FUEL INJECTION VALVE ATTACHING STRUCTURE IN ENGINE FOR SMALL-SIZED VEHICLE

(75) Inventors: Keiichiro Niizuma, Wako (JP); Koji Kobayashi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 120 days.

(21) Appl. No.: 12/177,631

(22) Filed: Jul. 22, 2008

(65) Prior Publication Data

US 2009/0031993 A1 Feb. 5, 2009

(30) Foreign Application Priority Data

Aug. 1, 2007 (JP) ..... 2007-201071

(51) Int. Cl.
*F02M 61/14* (2006.01)
*F02M 61/16* (2006.01)

(52) U.S. Cl. ..... 123/470

(58) Field of Classification Search ..... 123/470, 123/468, 469, 472, 478, 445, 456
See application file for complete search history.

(56) References Cited

U.S. PATENT DOCUMENTS 4,546,746 A * 10/1985 Sato et al. ..... 123/478
5,657,733 A * 8/1997 Dozier et al. ..... 123/470
5,664,533 A * 9/1997 Nakayama et al. ..... 123/184.42
5,682,859 A * 11/1997 Wakeman ..... 123/470
6,192,865 B1 * 2/2001 Hori et al. ..... 123/470
6,945,232 B2 * 9/2005 Ikeda et al. ..... 123/470
2004/0255909 A1 * 12/2004 Kurokawa et al. ..... 123/472
2005/0028790 A1 2/2005 Ikeda et al.
2005/0087175 A1 * 4/2005 Hotta et al. ..... 123/470
2005/0178364 A1 * 8/2005 Kobayashi et al. ..... 123/470
2007/0175688 A1 * 8/2007 Ishii et al. ..... 180/219

FOREIGN PATENT DOCUMENTS

EP 1 186 526 A2 3/2002
EP 1 304 283 A1 4/2003
JP 2006-130975 A 5/2006

OTHER PUBLICATIONS

European Search Report dated Nov. 14, 2008, issued in corresponding European Patent Application No. 08010514.1.

* cited by examiner

*Primary Examiner*—Mahmoud Gimie
(74) *Attorney, Agent, or Firm*—Westerman, Hattori, Daniels & Adrian, LLP

(57) ABSTRACT

A fuel injection valve attaching structure is provided in an engine for a small-sized vehicle. The vehicle includes a vehicle body frame, an engine mounted on the vehicle body frame, a crankshaft extending in a widthwise direction of the vehicle body frame, and a storage compartment positioned above the engine and supported by the vehicle body frame. The vehicle includes an intake device forming an intake path having a U-like shape in side view in cooperation with an intake port provided for a cylinder head as a part of the engine, connected above the cylinder head, and disposed between the engine and the storage compartment so as to extend rearward from the cylinder head. The vehicle includes a fuel injection valve attached to the cylinder head and having an axis tilted forward and outward of the vehicle body frame.

9 Claims, 6 Drawing Sheets

FUEL INJECTION VALVE ATTACHING STRUCTURE IN ENGINE FOR SMALL-SIZED VEHICLE

TECHNICAL FIELD

The present invention relates to an engine for a small-sized vehicle, the engine includes an engine body mounted on a vehicle body frame in a manner such that a crankshaft extending in width direction of the vehicle body frame is rotatably supported, and tilted with whose front rising until cylinder axis becomes almost horizontal; a storage compartment supported by the vehicle body frame so as to be positioned above the engine body; an intake device forming an intake path having an almost U shape in side view in cooperation with an intake port provided for a cylinder head as a part of the engine body, connected above the cylinder head, and disposed between the engine body and the storage compartment so as to extend rearward from the cylinder head; and a fuel injection valve for injecting fuel into the intake path.

More particularly, the invention relates to improvement in a fuel injection valve attaching structure.

BACKGROUND OF THE INVENTION

JP-A No. 2006-130975 (JP '975) discloses an example of a technique such that, in a scooter-type motorcycle, an intake device is connected above a cylinder head as a part of an engine body tilted with its front side rising until the cylinder axis becomes almost horizontal. Fuel injection means is provided for a throttle body as a part of the intake device.

In the technique disclosed in JP '975, in order to increase the capacity of a storage compartment disposed above the engine body, an intake port provided for the cylinder head is curved so that its upstream-side opening end is apart from the center in the width direction of the cylinder head to an outside, and the intake device is disposed in a position deviated from the center in the width direction of the cylinder head to the outside.

With such a configuration, the shape of the intake path is complicated. In addition, since the fuel injection means rises from the throttle body, it is necessary to devise the shape of the storage compartment in order to avoid interference with the fuel injection means.

SUMMARY OF THE INVENTION

The present invention has been achieved in view of such circumstances and an object of the invention is to provide a fuel injection valve attaching structure in an engine for a small-sized vehicle, realizing increased capacity of a storage compartment by reducing the influence exerted on the storage compartment and disposing a fuel injection valve in a position as low as possible, and realizing easier maintenance of a fuel injection valve.

To achieve this object, according to one aspect of the present invention, an engine for a small-sized vehicle is provided that includes an engine body mounted on a vehicle body frame in a manner such that a crankshaft extending in width direction of the vehicle body frame is rotatably supported, and tilted with whose front rising until cylinder axis becomes almost horizontal; a storage compartment supported by the vehicle body frame so as to be positioned above the engine body; an intake device forming an intake path having an almost U shape in side view in cooperation with an intake port provided for a cylinder head as a part of the engine body, connected above the cylinder head, and disposed between the engine body and the storage compartment so as to extend rearward from the cylinder head; and a fuel injection valve for injecting fuel into the intake path, the fuel injection valve for injecting fuel toward the intake port is attached to the cylinder head with axis of the fuel injection valve tilted forward and outward of the vehicle body frame.

Accordingly, since the fuel injection valve is attached to the cylinder head, the fuel injection valve can be disposed in a position lower than that in the case where the fuel injection valve is provided on the intake device side. Consequently, the influence of the fuel injection valve exerted on the storage compartment disposed above the engine body is decreased, and the capacity of the storage compartment can be increased. Moreover, since the fuel injection valve is attached to the cylinder head with the axis of the fuel injection valve tilted forward and outward of the vehicle body frame, maintenance of the fuel injection valve can be made easier.

According to another aspect of the present invention, a valve attachment hole for attaching the fuel injection valve is formed in the cylinder head while an end part is opened toward the intake port, and the entire opening at the end of the valve attachment hole lies in the intake port in a projection drawing on a plane including a center line of the intake port and parallel with the cylinder axis.

Accordingly, the entire opening at the end of the valve attachment hole provided for the cylinder head with the front end opened to the intake port lies in the intake port in side view. Thus, the position of the fuel injection valve is further lowered, and the capacity of the storage compartment can be further increased.

According to another aspect of the present invention, a chain path housing a cam chain for transmitting rotating power of the crankshaft to a camshaft in a state where the cam chain can run is provided in the engine body on one end side of the axis of the crankshaft, and the fuel injection valve is attached to the cylinder head on the other end side of the axis of the crankshaft.

Accordingly, the fuel injection valve of the cylinder head is attached on the side opposite to the chain path in the axial direction of the crankshaft. Therefore, a process of installation seat of the fuel injection valve to the cylinder head can be simplified. Moreover, since the fuel injection valve is disposed so as to be deviated from the intake path, the entire cylinder head including the fuel injection valve can be made compact, and maintenance of the fuel injection valve is also facilitated.

According to another aspect of the present invention, a recess is formed in an upper side face of the cylinder head, and the fuel injection valve is attached to the cylinder head so as to be housed in the recess.

Accordingly, the fuel injection valve is housed in the recess formed in the upper side face of the cylinder head. Consequently, projection of the fuel injection valve from the cylinder head is suppressed, interference of the fuel injection valve with the storage compartment is prevented, and the capacity of the storage compartment can be further increased.

According to another aspect of the present invention, a sensor is attached to a side face of the cylinder head on the other end side of the axis of the crankshaft, and a stay having a wire support part for supporting a wire connected to the sensor is fastened to the cylinder head jointly with the fuel injection valve.

Accordingly, it is unnecessary to assure a dedicated space in the cylinder head. The space is dedicated to attach a stay to the cylinder head, the stay having a wire support part for supporting a wire connected to the sensor which is fastened to a side face of the cylinder head.

An embodiment of the present invention will be described on the basis of an example of the present invention shown in accompanying drawings.

BRIEF DESCRIPTION OF THE DRAWINGS

A preferred embodiment of the present invention will be described with reference to the accompanying drawings, wherein.

DETAILED DESCRIPTION OF THE INVENTION

Figure 1:
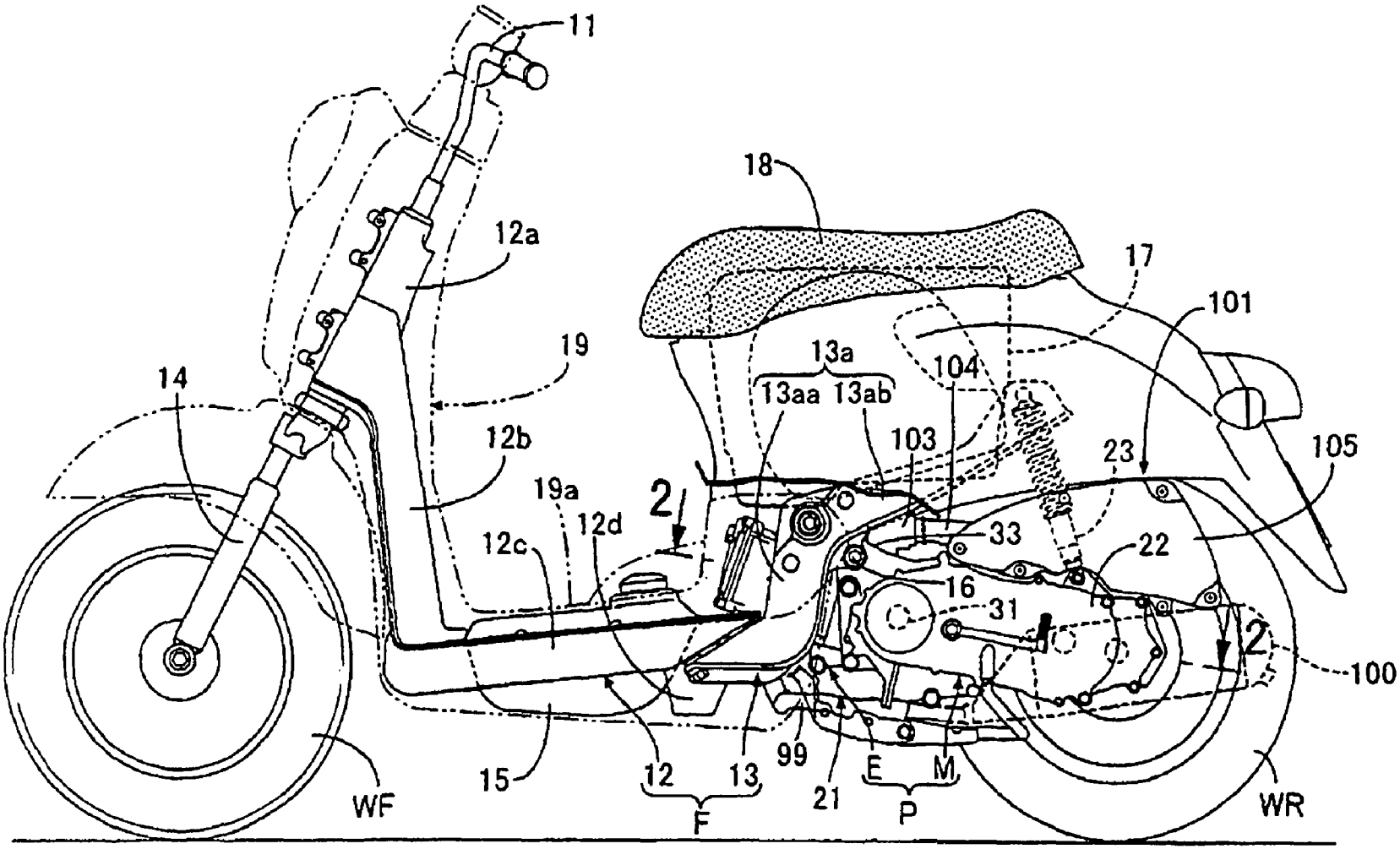
FIG. 1 is a left side view of a scooter-type motorcycle.
Figure 2:
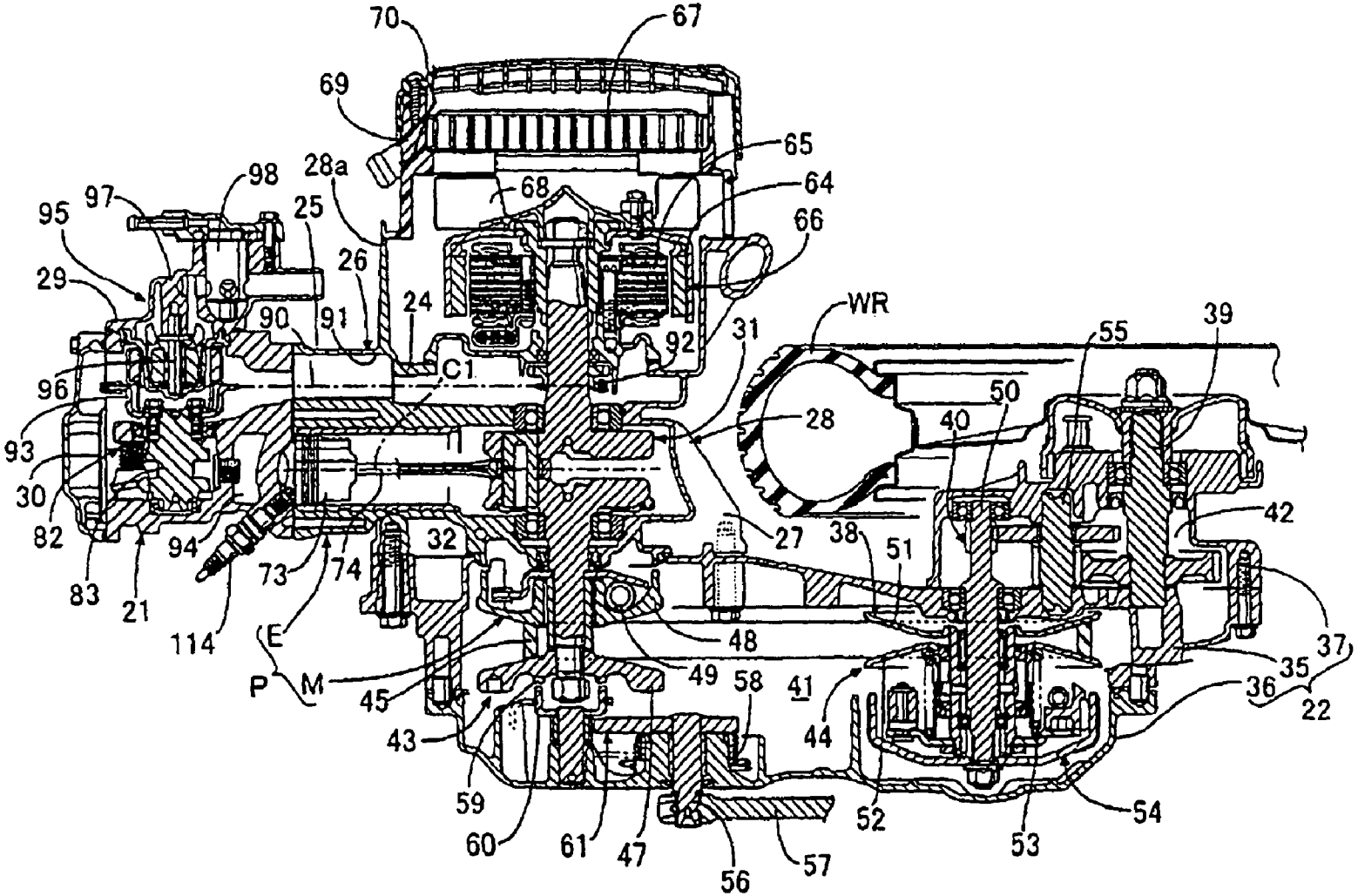
FIG. 2 is a cross section of a power unit taken along line 2-2 of FIG. 1.
Figure 3:
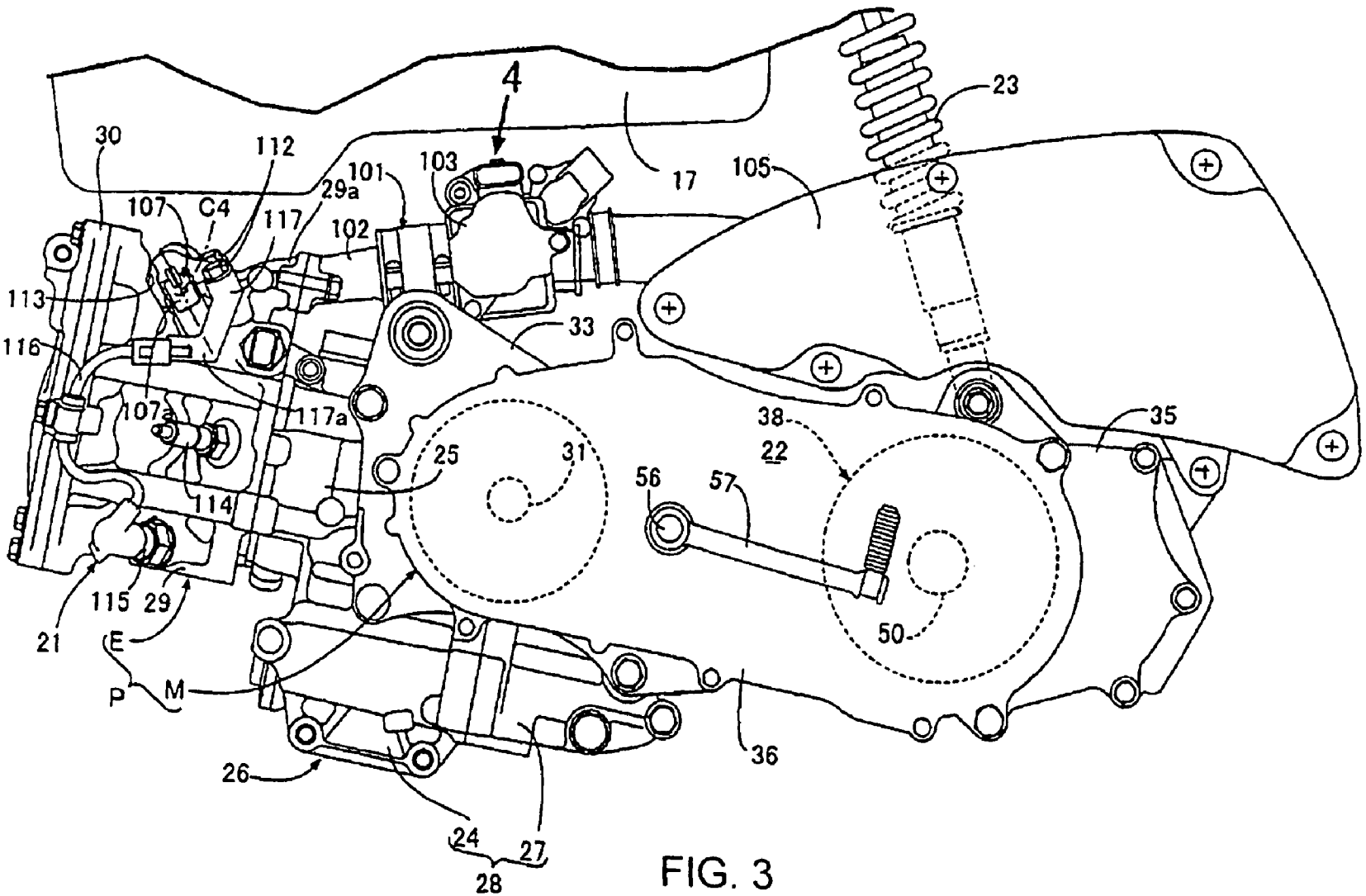
FIG. 3 is a left side view of the power unit.
Figure 4:
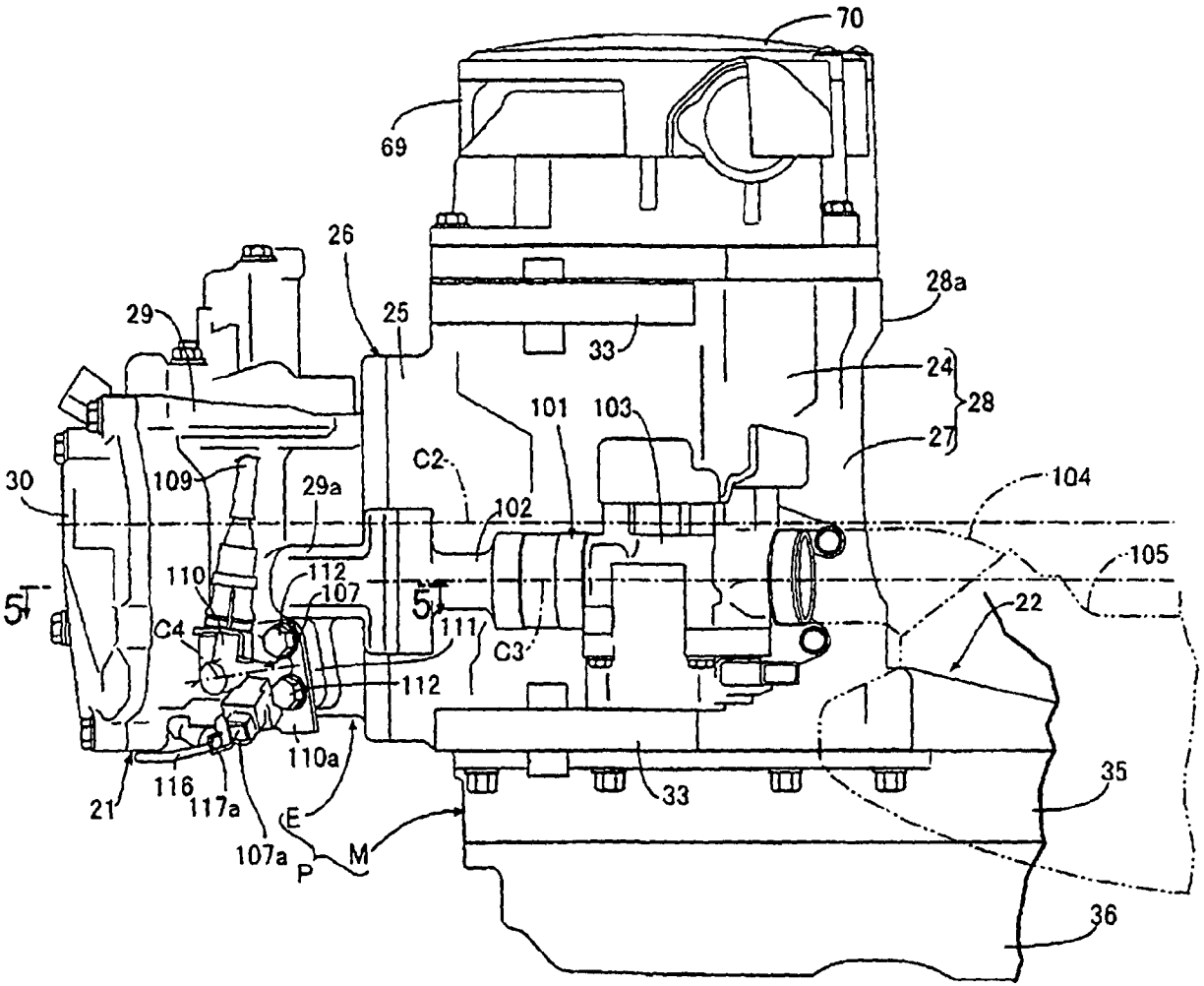
FIG. 4 is a plan view from arrow 4 in FIG. 3.
Figure 5:
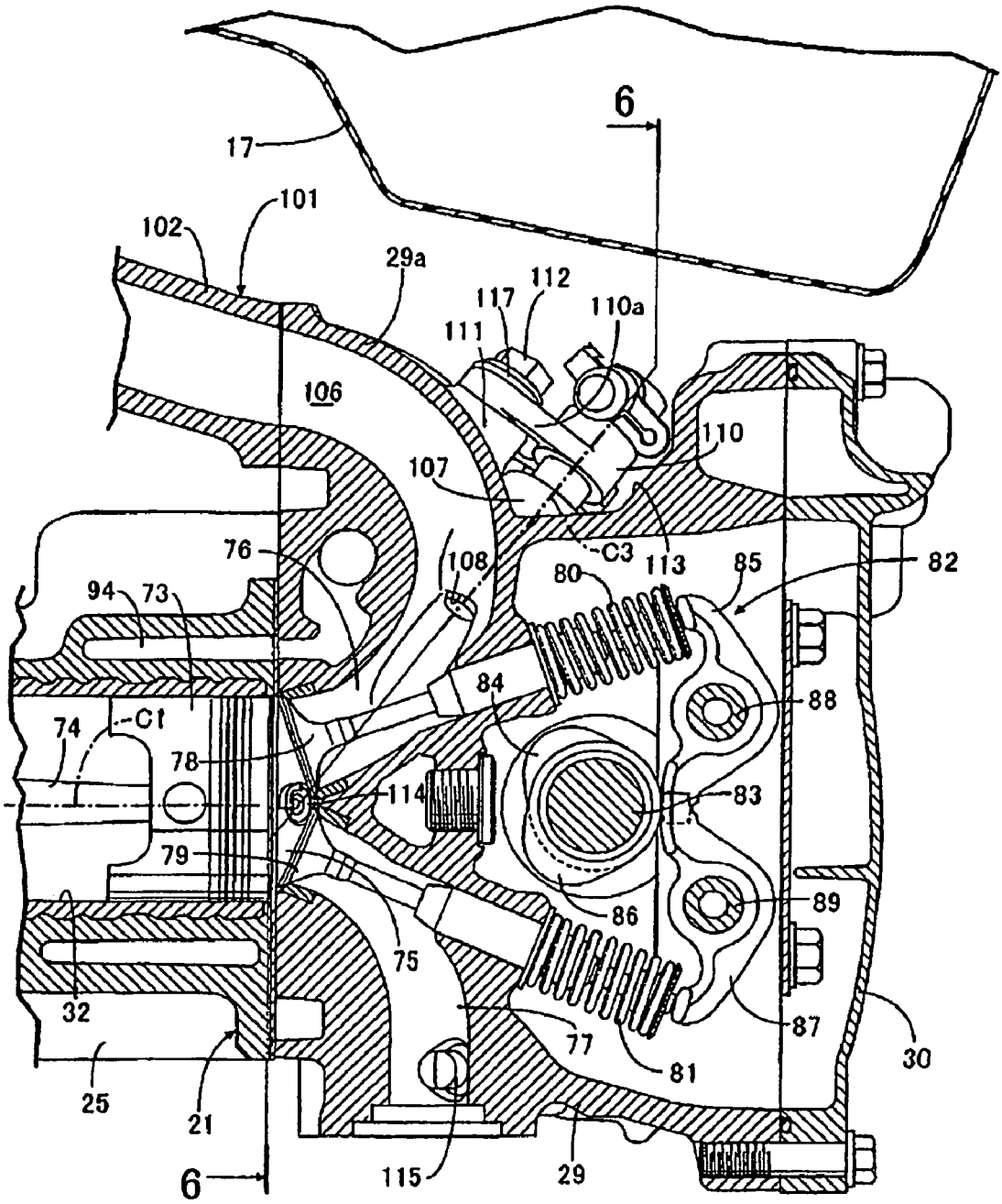
FIG. 5 is an enlarged cross section taken along line 5-5 of FIG. 4.
Figure 6:
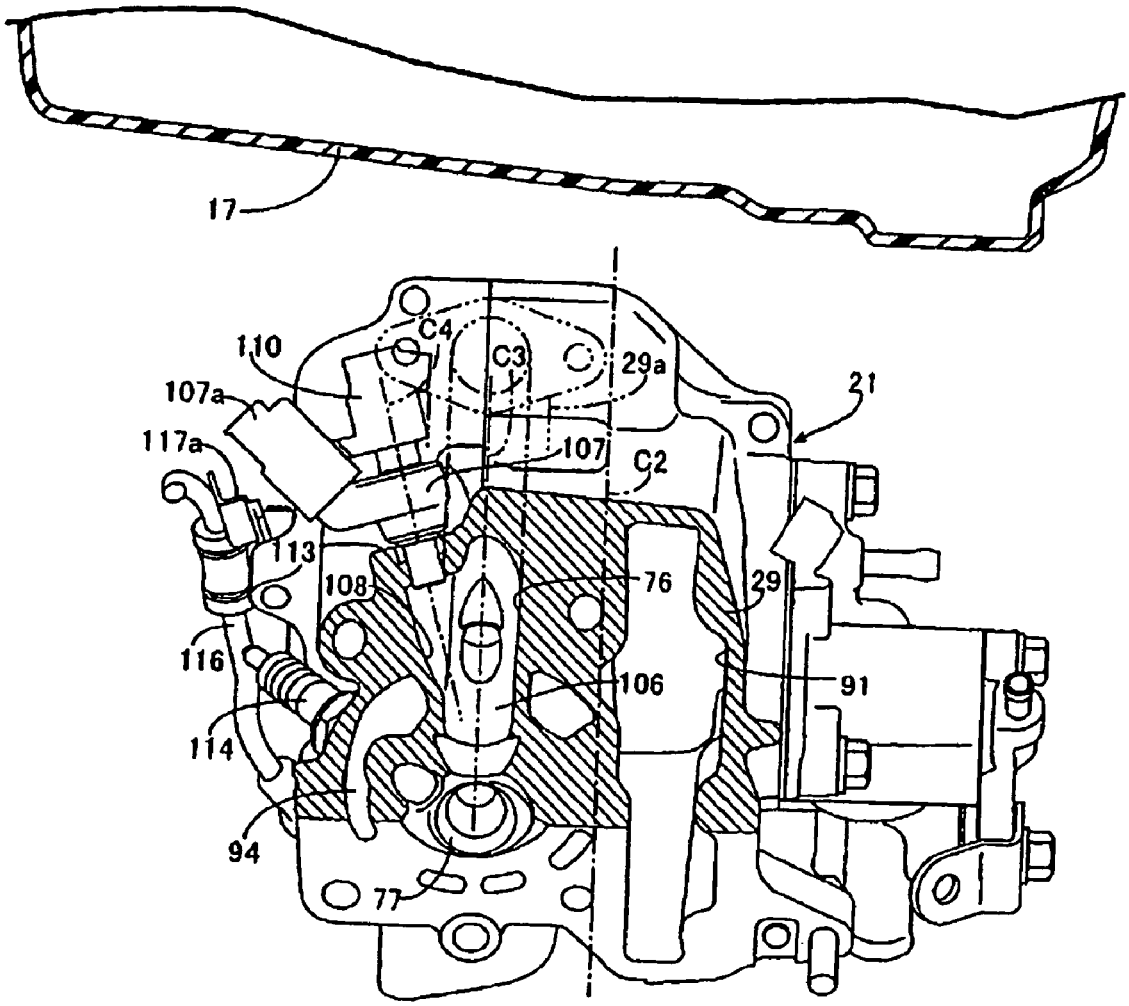
FIG. 6 is a cross section taken along line 6-6 of FIG. 5.

FIGS. 1 to 6 show an embodiment of the present invention. FIG. 1 is a left side view of a scooter-type motorcycle. FIG. 2 is a cross section of a power unit taken along line 2-2 of FIG. 1. FIG. 3 is a left side view of the power unit. FIG. 4 is a plan view from the arrow 4 in FIG. 3. FIG. 5 is an enlarged cross section taken along line 5-5 of FIG. 4. FIG. 6 is a cross section taken along line 6-6 of FIG. 5.

In FIG. 1, the scooter-type motorcycle has a front wheel WF steered by a steering handlebar 11 and a rear wheel WR driven by a swing-type power unit P. A vehicle body frame F is divided into a front frame 12 and a rear frame 13. The front frame 12 integrally has a head pipe 12*a* steerably supporting a front fork 14 journaled to the front wheel WF and the steering handlebar 11, a down frame 12*b* extending downwardly rearward from the head pipe 12*a*, a pair of right and left floor support frames 12*c* extending rearward from the bottom end of the down frame 12*b*, and a cross member 12*d* coupling the rear ends of the floor support frames 12*c*. The rear frame 13 is formed by coupling rear frame main parts 13*a* to the rear ends of the floor support frame parts 12*c* in a plurality of places. The rear frame main part 13*a* is made by a front-half part 13*aa* extending upwardly rearward from the rear end of the floor support frame part 12*c*, and a rear-half part 13*ab* extending upwardly rearward from the rear end of the front-half part 13*aa* so that the rear end rises more gently than the front-half part 13*aa*. The rear frame main part 13*a* is tilted upwardly rearward as a whole.

A fuel tank 15 is provided between the floor support frames 12*c* in the front frame 12. The power unit P is supported swingably via a spindle 16 in a part where the front-half parts 13*aa* and the rear-half parts 13*ab* in the rear frame main parts 13*a* in the rear frame 13 are continuously provided. A storage compartment 17 positioned above the power unit P is supported by the both rear frame main parts 13*a* in the rear frame 13. The storage compartment 17 is openably covered with a riding seat 18 from above. Further, the vehicle body frame F, the fuel tank 15, and a part of the power unit P are covered with a vehicle body cover 19 made of a synthetic resin. A step floor 19*a* disposed above the fuel tank 15 and supported by the floor support frames 12*c* is formed in the vehicle body cover 19.

The power unit P is made by a water-cooled single-cylinder engine E disposed on the front side of the rear wheel WR and a transmission device M disposed on the left side of the rear wheel WR. The transmission device M is housed in a transmission case 22 connected to the left side in the width direction of the vehicle body frame F in the engine body 21 of the engine E and extending rearward to the left side of the rear wheel WR. A rear cushion unit 23 is provided between the rear part of the transmission case 22 and the rear end of the left-side rear frame main part 13*a* in the both rear frame main parts 13*a*.

With reference to FIGS. 2 to 4, the engine body 21 of the engine E includes a first engine block 26 integrally having a crank-case half part 24 and a cylinder block 25, a second engine block 27 coupled to the crank-case half part 24 to form a crankcase 28, a cylinder head 29 coupled to the cylinder block 25, and a head cover 30 coupled to the cylinder head 29. The engine body 21 is disposed below the storage compartment 17. A crankshaft 31 having an axis extending in the width direction of the vehicle body frame F is rotatably supported in the crankcase 28.

The engine body 21 is mounted on the vehicle body frame F while being slightly tilted upward to the front until the axis of a cylinder bore 32, that is, a cylinder axis C1 becomes almost horizontal so as to be along the longitudinal direction of the vehicle body frame F. A pair of right and left brackets 33 provided above the rear side of the crankcase 28 are swingably supported via the spindle 16 in a part where the front-half parts 13*aa* and the rear-half parts 13*ab* in the rear frame main parts 13*a* of the rear frame 13 are connected.

The transmission case 22 is constructed by a case main body 35 coupled to the left side face of the crankcase 28 in the engine body 21 and extending rearward, a left cover 36 coupled to the case main body 35 from the left side, and a right cover 37 bonded to the rear part of the case main body 35 from the right side.

The transmission device M is constructed by a belt-type continuously variable transmission 38 for variably changing the rotating power of the crankshaft 31 steplessly, and a reduction gear series 40 provided between the axle 39 of the rear wheel WR and the belt-type continuous variable transmission 38. The belt-type continuous variable transmission 38 is housed in a transmission case 41 formed between the case main body 35 and the left cover 36 in the transmission case 22. The reduction gear series 40 is housed in a gear case 42 formed between the case main body 35 and the right cover 37 in the transmission case 22.

The belt-type continuously variable transmission 38 has a drive pulley 43 provided at the left end of the crankshaft 31 in the transmission case 41, a driven pulley 44 disposed in a rear part in the transmission case 41, and an endless V-belt 45 looped over the drive pulley 43 and the driven pulley 44.

The drive pulley 43 has a fixed-side pulley half-body 47 fixed to the crankshaft 31, and a movable-side pulley half-body 48 which can move toward or apart from the fixed-side pulley half-body 47. The movable-side pulley half-body 48 is energized toward the fixed-side pulley half-body 47 by a centrifugal weight 49 which moves outward in the radial direction in accordance with increase in the number of revolutions of the crankshaft 31.

An output shaft 50 having the axis parallel with that of the crankshaft 31 is rotatably supported by the case main body 35 and the right cover 37 in the rear part of the transmission case 22. The driven pulley 44 has a fixed-side pulley half-body 51 relative-rotatably supported by the output shaft 50, and a movable-side pulley half-body 52 capable of moving toward/apart from the fixed-side pulley half-body 51. The movable-side pulley half-body 52 is energized toward the fixed-side pulley half-body 51 by a spring 53. A clutch 54 for starting is provided between the fixed-side pulley half-body 51 and the output shaft 50.

In the rear part of the case main body 35 and the right cover 37 in the transmission case 22, the output shaft 50, an intermediate shaft 55 parallel with the output shaft 50, and the axle 39 are rotatably supported. The reduction gear series 40 is provided between the output shaft 50 and the intermediate shaft 55 and the axle 39, and the rear wheel WR is provided at the right end of the axle 39 penetrating the right cover 37 and projecting to the right side.

Consequently, the rotating power of the crankshaft 31 is transmitted to the drive pulley 43 and transmitted from the drive pulley 43 to the rear wheel WR via the V belt 45, driven pulley 44, clutch 54 for starting, and reduction gear series 40.

Since the centrifugal force acting on the centrifugal weight 49 in the drive pulley 43 is small when the engine E rotates at low speed, the groove width between the fixed-side pulley half-body 51 and the movable-side pulley half-body 52 is reduced by the spring 53 of the driven pulley 44, and the gear ratio is low. When the number of revolutions of the crankshaft 31 increases from this state, the centrifugal force acting on the centrifugal weight 49 increases, the groove width between the fixed-side pulley half-body 47 and the movable-side pulley half-body 48 in the drive pulley 43 decreases and, accordingly, the groove width between the fixed-side pulley half-body 51 and the movable-side pulley half-body 52 in the driven pulley 44 increases. Therefore, the transmission ratio changes steplessly from low to top.

In an intermediate part in the longitudinal direction of the transmission case 22, a kick shaft 56 having an axis parallel with the crankshaft 31 is rotatably supported in the left case 46. A kick pedal 57 is fixed to the end of a projection from the left cover 36 of the kick shaft 56. Moreover, a return spring 58 is provided between the kick shaft 56 and the left cover 36.

On the other hand, an engagement member 60 coaxially facing a member 59 to be engaged which is provided at the end of the crankshaft 31 is supported by the left cover 36 of the transmission case 22 while being allowed to rotate around the axis coaxial with the crankshaft 31 and to move in the axial direction. A speed increasing gear series 61 is provided between the kick shaft 56 and the engagement member 60. By an operation of stepping on the kick pedal 57, the rotation of the kick shaft 56 is increased by the speed increasing gear series 61 and transmitted to the engagement member 60. The engagement member 60 moves forward to come into contact with the member 59 to be engaged and rotates, thereby transmitting the rotating power for starting to the crankshaft 31.

A rotor 64 is fixed at the right end of the crankshaft 31, and a stator 65 as a component of a generator 66 in cooperation with the rotor 64 is fixed to the right side face of the crankcase 28 so as to be enclosed by the rotor 64. A radiator 67 is disposed outside of the generator 66 and is on a side of the crankcase 28. A cooling fan 68 for attracting cooling air so that the cooling air passes through the radiator 67 is attached at the right end of the crankshaft 31 so as to sandwich the generator 66 between the crankcase 28 and itself.

A cylindrical support case 28*a* enclosing the generator 66 from sides is provided at the right face of the crankcase 28. A shroud 69 covering the cooling fan 68 from sides is provided between the radiator 67 and the support case 28*a*. The radiator 67 is covered from sides with a radiator cover 70 made of a synthetic resin.

Referring also to FIG. 5, a piston 73 which slidably fits in the cylinder bore 32 is connected to the crankshaft 31 via a connecting rod 74. A combustion chamber 75 is formed between the cylinder block 25 and the cylinder head 29 so as to face the top part of the piston 73. The cylinder head 29 is provided with an intake port 76 opened in the top of the cylinder head 29 so as to be communicated with the combustion chamber 75, and an exhaust port 77 opened at the bottom of the cylinder head 29 so as to be communicated with the combustion chamber 75. An intake valve 78 for switching opening/closing of the intake port 76 and an exhaust valve 79 for switching opening/closing of the exhaust port 77 are disposed so as to be opened/closed. The intake valve 78 and the exhaust valve 79 are energized in the closing direction by valve springs 80 and 81.

A valve train 82 for opening/closing the intake valve 78 and the exhaust valve 79 is housed between the cylinder head 29 and the head cover 30. The valve train 82 has: a camshaft 83 having an axis parallel with the crankshaft 31 and rotatably supported by the cylinder head 29; an intake-side rocker arm 85 provided between an intake-side cam 84 provided for the camshaft 83 and the intake valve 78; and an exhaust-side rocker arm 87 provided between an exhaust-side cam 86 provided for the camshaft 83 and the exhaust valve 79. The intake-side and exhaust-side rocker arms 85 and 87 are swingably supported by rocker shafts 88 and 89 supported by the cylinder head 29.

Referring to FIG. 2, on one end side (right end side) along the axis of the crankshaft 31, in the crankcase 28, the cylinder block 25, and the cylinder head 29, a chain path 91 housing a cam chain 90 for passing the rotating power of the crankshaft 31 at a reduction ratio of 1/2 to the camshaft 83 so that the cam chain 90 can run is provided. The cam chain 90 is looped over a drive sprocket 92 provided for the crankshaft 31 and a driven sprocket 93 provided for the camshaft 83.

On the right side of the cylinder head 29, a water pump 95 for circulating cooling water in a water jacket 94 provided for the cylinder block 25 and the cylinder head 29 in the engine body 21 is disposed. A pump shaft 96 of the water pump 95 is coupled to the camshaft 83 coaxially and relatively-unrotatably. A thermostat 98 is attached to a pump case 97 of the water pump 95.

The upstream end of an exhaust pipe 99 (refer to FIG. 1) extending rearward from the lower part of the cylinder head 29 is connected to the exhaust port 77, and the downstream end of the exhaust pipe 99 is connected to an exhaust muffler 100 disposed on the right side of the rear wheel WR.

An intake pipe part 29*a* in which the intake port 76 is curved rearward from the upper side wall of the cylinder head 29 is provided integrally with the upper part of the cylinder head 29. The intake pipe part 29*a* is provided integrally with the upper part of the cylinder head 29 so that a center line C3 of the intake port 76 is disposed in a position deviated to the left side from the vehicle body center C2 as shown in FIG. 4. To the intake pipe part 29*a*, an intake device 101 disposed between the engine body 21 and the storage compartment 17 so as to extend rearward from an upper part of the cylinder head 29 is connected.

The intake device 101 includes an intake pipe 102 connected to the intake pipe part 29*a*, a throttle body 103 connected to the upstream end of the intake pipe 102, a connecting tube 104 whose downstream end is connected to the throttle body 103, and an air cleaner 105 disposed in an upper part of the transmission case 22 and connected to the upstream end of the connecting tube 104.

An intake path 106 having an almost U shape in side view is formed by the intake pipe 102 of the intake device 101 and the intake port 76 in the cylinder head 29. A fuel injection valve 107 for injecting fuel toward the intake path 106 is attached to the cylinder head 29 so that a coupler 107*a* provided for the fuel injection valve 107 is directed outwardly obliquely upward.

Referring also to FIG. 6, on one end side of the axis of the crankshaft 31, the chain path 91 housing the cam chain 90 so that the cam chain 90 can run is provided in the cylinder block 25 and the cylinder head 29 in the engine body 21. On the other end side of the axis of the crankshaft 31, a valve attachment hole 108 for attaching the fuel injection valve 107 is formed in the cylinder head 29 so that its end is open to the intake port 76. Further, the entire opening at the end of the valve attachment hole 108 lies in the intake port 76 in the projection diagram (FIG. 5) onto a plane including the center line of the intake port 76 and parallel with the cylinder axis C1.

A cap 110 continued to a fuel supply path 109 for supplying fuel to the fuel injection valve 107 is fit on the rear part of the fuel injection valve 107 whose front end is fit in the valve attachment hole 108. A support arm 110*a* integrally having the cap 110 is fastened to an attachment boss 111 provided for the cylinder head 29 by, for example, two bolts 112, thereby attaching the fuel injection valve 107 to the cylinder head 29. Moreover, the axis of the fuel injection valve 107 attached to the cylinder head 29, that is, the axis C4 of the valve attachment hole 108 is tilted to the front side and outside of the vehicle body frame F.

A recess 113 is formed in the upper side face of the cylinder head 29, and the fuel injection valve 107 is attached to the cylinder head 29 so as to be housed in the recess 113.

A spark plug 114 whose rear end faces the center portion of the combustion chamber 75 and an oxygen sensor 115 whose tip faces the exhaust port 77 are attached to the left side face of the cylinder head 29 opposite to the change path 91. A wire 116 connected to the oxygen sensor 115 is installed along the left side face of the cylinder head 29. A stay 117 having a wire supporting part 117*a* for supporting some midpoint of the wire 116 is fastened to the cylinder head 29 jointly with the fuel injection valve 107. That is, the stay 117 is sandwiched by the support arm 110*a* of the cap 110 fit on the rear part of the fuel injection valve 107 and the attachment boss 111 of the cylinder head 29. The support arm 110*a* and the stay 117 are fastened to the attachment boss 111 by the bolts 112.

The action of the embodiment will now be described. Since the fuel injection valve 107 for injecting fuel toward the intake port 76 of the cylinder head 29 is attached to the cylinder head 29, as compared with the case where the fuel injection valve 107 is provided on the intake device 101 side, the fuel injection valve 107 can be disposed in a lower position. As a result, the influence of the fuel injection valve 107 exerted on the storage compartment 17 disposed in an upper part of the engine body 21 is reduced, and the capacity of the storage compartment 17 can be increased.

Moreover, the fuel injection valve 107 is attached to the cylinder head 29 with the axis C4 of the fuel injection valve 107 tilted forward and outward of the vehicle body frame F. Thus, maintenance of the fuel injection valve 107 can be facilitated.

The valve attachment hole 108 for attaching the fuel injection valve 107 is formed in the cylinder head 29 with the front end part of the valve attachment hole 108 open to the intake port 76. The entire front end part of the valve attaching hole 108 lies in the intake port 76 in a projection drawing on a plane parallel with the cylinder axis C1 including the center line of the intake port 76. Thus, the position of the fuel injection valve 107 can be further lowered, and the capacity of the storage compartment 17 can be further increased.

The chain path 91 housing the cam chain 90 for transmitting the rotating power of the crankshaft 31 at a reduction ratio of 1/2 to the camshaft 83 to the camshaft 83 at a reduction ratio of 1/2 so that the cam chain 90 can run is provided for the engine body 21 on the side of one end of the axis of the crankshaft 31, and the fuel injection valve 107 is attached to the cylinder head 29 on the side of the other end of the axis of the crankshaft 31. Thus, the process of an installation seat of the fuel injection valve 107 to the cylinder head 29 can be simplified. Moreover, the fuel injection valve 107 is disposed while being offset from the intake path 106. Consequently, the entire cylinder head 29 including the fuel injection valve 107 can be made compact, and maintenance of the fuel injection valve 107 is also facilitated.

The recess 113 is formed in the upper side face of the cylinder head 29, and the fuel injection valve 107 is attached to the cylinder head 29 so as to be housed in the recess 113. Therefore, projection of the fuel injection valve 107 from the cylinder head 29 can be suppressed, and the fuel injection valve 107 does not interfere with the storage compartment 17. Thus, the capacity of the storage compartment 17 can be further increased.

Further, the oxygen sensor 115 is attached to the side face of the cylinder head 29 at the other end side of the axis of the crankshaft 31, and the stay 117 having the wire supporting part 117*a* for supporting the wire 116 lined with the sensor 115 is fastened to the cylinder head 29 jointly with the fuel injection valve 107. Thus, it is unnecessary to assure a space dedicated to attach the stay 117 having the wire supporting part 117*a* for supporting the wire 116 to the cylinder head 29 in the cylinder head 29.

The embodiment of the present invention has been described above but the invention is not limited to the embodiment. Various design changes are possible without departing from the present invention described in the scope of claims.

We claim:

1. A fuel injection valve attaching structure in an engine for a small-sized vehicle, comprising:

a vehicle body frame;

an engine body mounted on the vehicle body frame;

a crankshaft rotatably supported and extending in a widthwise direction of the vehicle body frame;

a storage compartment positioned above the engine body and supported by the vehicle body frame;

an intake device forming an intake path having a U-like shape in side view in cooperation with an intake port provided for a cylinder head as a part of the engine body, connected above the cylinder head, and disposed between the engine body and the storage compartment so as to extend rearward from the cylinder head; and a fuel injection valve for injecting fuel into the intake path, wherein the fuel injection valve is integral with an upper portion of a side intake pipe part of the cylinder head, and an axis of the fuel injection valve is tilted forward and outward of the vehicle body frame.

2. The fuel injection valve attaching structure in an engine for a small-sized vehicle according to claim 1, further comprising:

a valve attachment hole for attaching the fuel injection valve, wherein the valve attachment hole is formed in the cylinder head while an end part is opened toward the intake port, and wherein the entire opening at the end of the valve attachment hole lies in the intake port in a projection drawing on a plane including a center line of the intake port and parallel with an axis of the cylinder.

3. The fuel injection valve attaching structure in an engine for a small-sized vehicle according to claim 1, further comprising:

a camshaft;

a cam chain for transmitting rotating power of the crankshaft to the camshaft; and a chain path housing the cam chain is provided in the engine body on one end side of an axis of the crankshaft; and the fuel injection valve is attached to the cylinder head on the other end side of the axis of the crankshaft.

4. The fuel injection valve attaching structure in an engine for a small-sized vehicle according to claim 2, further comprising:

a camshaft;

a cam chain for transmitting rotating power of the crankshaft to the camshaft; and a chain path housing the cam chain is provided in the engine body on one end side of an axis of the crankshaft; and the fuel injection valve is attached to the cylinder head on the other end side of the axis of the crankshaft.

5. The fuel injection valve attaching structure in an engine for a small-sized vehicle according to claim 1, further comprising:

a recess formed in an upper side face of the cylinder head, wherein the fuel injection valve is attached to the cylinder head and housed in the recess.

6. The fuel injection valve attaching structure in an engine for a small-sized vehicle according to claim 2, further comprising:

a recess formed in an upper side face of the cylinder head, wherein the fuel injection valve is attached to the cylinder head and housed in the recess.

7. The fuel injection valve attaching structure in an engine for a small-sized vehicle according to claim 3, further comprising:

a recess formed in an upper side face of the cylinder head, wherein the fuel injection valve is attached to the cylinder head and housed in the recess.

8. The fuel injection valve attaching structure in an engine for a small-sized vehicle according to claim 3, further comprising:

a sensor attached to a side face of the cylinder head on the other end side of the axis of the crankshaft; and a stay having a wire supporting part for supporting a wire connected to the sensor, wherein the stay is jointly fastened to the cylinder head with the fuel injection valve.

9. The fuel injection valve attaching structure in an engine for a small-sized vehicle according to claim 5, further comprising:

a sensor attached to a side face of the cylinder head on the other end side of the axis of the crankshaft; and a stay having a wire supporting part for supporting a wire connected to the sensor, wherein the stay is jointly fastened to the cylinder head with the fuel injection valve.

* * * * *